United States Patent [19]

Maurer et al.

[11] 4,411,854

[45] Oct. 25, 1983

[54] PROCESS FOR THE PRODUCTION OF FILAMENTS WITH HIGH TENSILE STRENGTH AND MODULUS

[75] Inventors: Franciscus H. J. Maurer, Voerendaal; Jacques P. L. Pijpers, Limbricht, both of Netherlands; Paul Smith, Grenoble, France

[73] Assignee: Stamicarbon B.V., Geleen, Netherlands

[21] Appl. No.: 331,080

[22] Filed: Dec. 15, 1981

[30] Foreign Application Priority Data

Dec. 23, 1980 [NL] Netherlands ..... 8006994

[51] Int. Cl.[3] ..... D01F 6/00

[52] U.S. Cl. ..... 264/205; 264/210.8; 264/211; 264/290.5

[58] Field of Search ..... 528/502; 264/210.8, 264/211, 290.5, 203, 205

[56] References Cited

U.S. PATENT DOCUMENTS

| | | | |
|---|---|---|---|
| 3,017,238 | 1/1962 | Levine et al. | 264/203 |
| 3,048,465 | 8/1962 | Jungeleit | 264/203 |
| 3,210,452 | 10/1965 | Howard | 264/203 |
| 3,367,926 | 2/1968 | Voeks | 264/211 |
| 3,763,109 | 10/1973 | Witsiepe | 528/305 |
| 4,020,266 | 4/1977 | Frank et al. | 528/502 |
| 4,137,394 | 1/1979 | Meihuizer et al. | 528/502 |
| 4,344,908 | 8/1982 | Smith et al. | 264/290.5 |

FOREIGN PATENT DOCUMENTS

| | | | |
|---|---|---|---|
| 37-9765 | 7/1962 | Japan | 264/211 |
| 1100497 | 1/1968 | United Kingdom | 264/203 |

*Primary Examiner*—Jay H. Woo

[57] ABSTRACT

Process for the production of filaments of polyethylene with high modulus and tensile strength, comprising spinning a filler containing solution of a linear polyethylene with a weight-average molecular weight ($M_w$) of at least 400,000 to form filled filaments and then stretching the filaments.

5 Claims, 2 Drawing Figures

PROCESS FOR THE PRODUCTION OF FILAMENTS WITH HIGH TENSILE STRENGTH AND MODULUS

BACKGROUND OF THE INVENTION

The invention relates to filaments with high tensile strength and modulus and to a process for the production thereof.

The Netherlands patent application No. 79.04990 contains a description of such filaments which are produced by spinning a solution of linear polyethylene with a weight-average molecular weight of at least 400,000 and stretching the filaments with a stretch ratio of at least $12\times10^6/M_w+1$, at such a temperature that the modulus of the filaments is at least 20 GPa. $M_w$ is the weight-average molecular weight.

In the Netherlands patent application Nos. 74.02956 and 74.13069 melt spinning, i.e., the spinning of molten polyethylene with a weight-average molecular weight lower than 300,000, is described. According to the Netherlands patent application No. 76.12315 a polyethylene with a higher molecular weight of up to 2,000,000 can also be processed. The examples merely describe the extremely slow stretching of dumb-bell shaped samples of polyethylene with a molecular weight of 800,000 at most made by pressing, or the stretching of melt-spun filaments of a polyethylene with a molecular weight ($M_w$) of 312,000 or lower.

The most economic and most frequently used process of making filaments is melt spinning. To this end, the material to be spun must be capable of being melted and be reasonably stable in melted condition. The viscosity of the melt must permit a reasonable spinning speed. The spinnability of a meltable polymer decreases as the molecular weight increases, and that is why high-molecular polyethylene, e.g. with molecular weights ($M_w$) of at least about 400,000, more specifically of at least 1,000,000, can be spun at satisfactory speeds only from solutions.

The filaments spun must generally be stretched above the glass transition temperature, $T_R$, of the polymer. On the other hand, the stretching should preferably be carried out below the melting point of the polymer, because above this temperature the mobility of the macromolecules will rapidly reach the point where the desired orientation cannot or cannot sufficiently be effected. Generally, it is recommended to stretch at least 5° C. below the melting point. As a consequence of the stretching energy expended on the filaments, there will be an intramolecular development of heat. As a result, at high stretching speeds the temperature in the filaments may rise considerably and care should be taken that it does not rise too high. In the stretching process it has been discovered that because of the increasing degree of order of the polymer molecules, the melting point will usually rise. Therefore, temperatures may often be somewhat higher by the end of the stretching process and may be beyond the melting point in unstretched condition.

The spinning of solutions of polymers is also described in the Netherlands patent application No. 65.01248. The filaments produced by spinning a solution of, for instance, a polyethylene with a molecular weight of $1\times10^6$ to $3\times10^6$ are put on bobbins. No information is given about the method of stretching (stretch ratios, stretching speeds, etc.), nor about the final strength. The threads put on bobbins must first be subjected to a cumbersome washing-out treatment. In this treatment shrinkage of the threads on the bobbins will occur, which will result in widely different degrees of stretching and may even result in breaking.

DESCRIPTION OF THE INVENTION

It has now been discovered that filaments of polyethylene with a high modulus and tensile strength can be made by spinning a filler containing solution of a linear high molecular polyethylene with a weight average molecular weight of at least about 400,000 and stretching the filler containing filaments.

Preferably, at least a substantial part, i.e. more than about 50% by weight, of the solvent will be removed from the filaments by evaporation or washing. This will then be followed by stretching. Even more preferably enough solvent will be removed so that the filaments will contain about 25% by weight of solvent at most, which will then be followed by stretching. However, a procedure similar to that described in the Netherlands patent application No. 79.00990 may also be followed i.e., stretching filaments containing substantial quantities of solvent.

Preference is given to stretching the filaments at least $12\times10^6/M_w+1$ time, where $M_w$ is the weight average molecular weight of the polyethylene, and even more preferably filaments at least $14\times10^6/M_w+1$.

While the present invention has been described with respect to the spinning of filaments, it will immediately be obvious to the expert that the process of the present invention may also employ spinning heads with slit dies. The invention, therefore, not only comprises filaments with more or less round cross sections, but also small ribbons produced in a similar manner, or in fact almost any cross section.

The mixing of plastics with fillers is known. Filaments of filled polyethylene are known from the Japanese patent publication No. 78.28.644, which describes a mixture of polyethylene, an active filler and a peroxy compound being melted and then spun from the melt to form filaments which are stretched nine times. Furthermore, in SPE Journal 28 (June 1972) 54–58 and Kobunshi Ronbunshu, Eng. Ed. 5 (1976) 635–645, filled films and ribbons are described which are made by extruding plastic mixed with filler. The extruded films or ribbons are oriented by stretching.

DETAILED DESCRIPTION OF THE INVENTION

Figure 1:
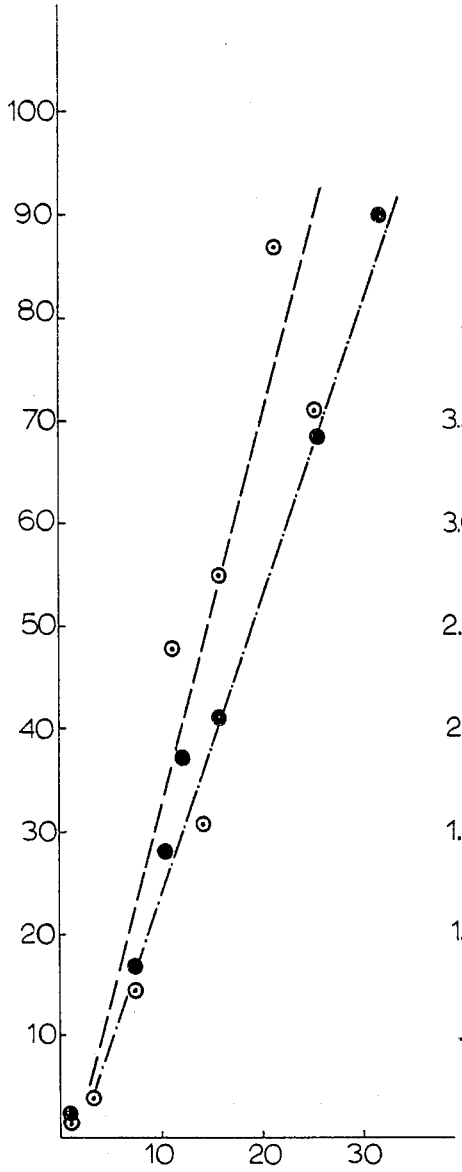
FIG. 1 is a graphical representation of the modulus plotted against the stretch ratio for the filaments prepared in Example I and Comparative Example A.

Until the present invention, the stretching of filaments or ribbons of filled plastics has been possible to only a limited degree. Proper stretching could not be achieved owing to premature breaking. The stretching is necessary to improve the properties of, for instance, modulus and tensile strength. Generally, as the stretch ratio increases, the properties, particularly the modulus and tensile strength, improve. Because of the decrease of the possible stretch ratio in such filled filaments, properties such as modulus and tensile strength will be inferior to those possible with a higher stretch ratio. Often this means that improvements of the properties that are achievable by the incorporation of fillers will be lost because of the poorer stretchability.

Unexpectedly, it has now been discovered that the stretchability of the filler containing filaments according to the present invention is equal to or only slightly less than that of similar unfilled filaments. As a result, the tensile strengths and moduli are very good, and with the use of reinforcing fillers even better than those of unfilled filaments.

Filler containing polyethylene solutions as used in accordance with this invention may be prepared by any method yielding filler containing solvent polyethylene mixtures. Thus, these filler containing polyethylene solutions may be produced, for example, by the swelling and dissolving of polyethylene material in a suspension of filler material in a solvent, by the swelling and dissolving in a solvent of a kneaded polymer filler mixture, or by the polymerization of ethylene in a solvent in the presence of a suspended filler material, etc.

A special advantage of the present invention is that the homogeneous distribution of the filler in a solution of high molecular polyethylene is easier to achieve. The homogeneous distribution of a filler in high molecular polyethylene by kneading is an extremely difficult and slow process.

The quantities of fillers which are incorporated in the polyethylene may vary widely, but will generally be at least about 5% by volume and at most about 60% by volume. Smaller quantities are, of course, possible but are of little advantage. Larger quantities are possible in principle, but present an increasing danger of the filament structure being disturbed and of the mechanical and physical properties becoming worse.

Filler containing filaments according to the present invention are not only cheaper because of the substantially lower cost of the fillers, but generally have better mechanical properties. Moreover, the surface of the filled filaments is generally less smooth, which is highly desirable for certain uses.

The fillers to be incorporated in the polyethylene may be of a varying nature. The filler particles may be fiber shaped, needle shaped, globular or plate shaped, but other, more irregular and/or intermediate forms may be used as well. Not only can the usual fillers be used, but fillers with special properties, such as, for instance, magnetic materials, electrically conductive substances, or substances with a high dielectric constant can also be employed. Mixtures of fillers can be applied as well.

Reinforcing fillers whose surfaces are covered with a substance having affinity to the polymer, can be used also. An example of this is calcium carbonate covered with stearic acid. The stearic acid is bound to the filler particles via the acid group. The remaining hydrocarbon will then effect a substantial improvement of the mixability of filler and polyethylene. Calcium carbonate may be covered also with unsaturated compounds, for instance, with acrylic acid, in which the acid group is reactive in respect of the filler and the remaining alkene is reactive in respect of the polyethylene. The reactivity can, moreover, be promoted by small quantities of peroxide. In addition to calcium carbonate, barium carbonate and magnesium carbonate are carbonates often used as fillers.

In addition to carbonates, silicates, oxides, sulphates, hydroxides are used as fillers, of which particularly the silicates are rich in varieties such as clay, talcum, mica, asbestos, feldspar, bentonite, pumice, pyrophyllite, vermiculite, etc. Oxides which can be used as fillers are, for example, aluminium oxide, magnesium oxide, titanium oxide and silicon oxide, as well as mixed oxides. Gypsum is a much used sulphate filler. The above enumeration is given only as an example and is by no means meant to be a limitative enumeration. Other fillers, too, such as carbon in varying modifications, non-mixing polymers, metal powders, glass powders, etc. can be used. Fillers in polymers are generally known in the art, and all fillers known can be used within th scope of the present invention.

The solution of high molecular linear polyethylene ($M_w$, about $4\times10^5$) generally contains at least about 1% and at most about 50% by weight of polyethylene. Solutions with concentrations lower than about 1% by weight can be spun, but the spinning thereof is generally of no advantage, although sometimes it may be favorable, for very high molecular polyethylene, to process solutions having concentrations lower than about 1% by weight.

High molecular linear polyethylene is here understood to mean polyethylene which may contain minor quantities, preferably about 5 moles % at most, of one or more other alkenes copolymerized therewith, such as propylene, butylene, pentene, hexene, 4-methylpentene, octene, etc., with fewer than one side chain per 100 carbon atoms, and preferably with fewer than one side chain per 300 carbon atoms, and with a weight average molecular weight of at least about $4\times10^5$, preferably at least about $8\times10^5$. The polyethylene may contain minor quantities, preferably about 25% by weight at most, of one or more other polymers, specifically an alkene-1-polymer, such as polypropylene, polybutylene or a copolymer of propylene with a minor quantity of ethylene.

The filaments obtained according to the present invention are further processed according to usual methods. They can be passed into a shaft throughout which hot air can be passed and in which the solvent can be wholly or partly evaporated. The solvent can also be wholly or partly washed from the filaments, or be further evaporated therefrom in a zone following the drying shaft. The filaments from which the solvent has wholly or largely been evaporated or washed out, i.e. the filaments generally contain less than about 25% by weight and preferably less than about 10% by weight of solvent, will then be strongly stretched. The filaments issuing from the spinneret can also be passed into an area in which they are cooled, without substantial evaporation of the solvent, to form a gel shaped filament and subsequently stretched. When solvent containing filaments are stretched, preference should be given to evaporating or washing the solvent from the filament during the stretching as far as possible, although it can also be removed from the filaments after the stretching operation.

It has been discovered that, as the stretch ratio increases, the modulus and the tensile strength increase. The stretch ratio cannot be increased indefinitely, becase at a too high stretch ratio breaking will occur. It is easy to determine by experiment at which stretch ratio the breaking of the filaments will frequently occur as to involve an unacceptable disturbance of the continuity of the production. As discussed above, the presence of the filler has only little or no influence on the stretch ratio.

Another advantage of the present process is that usually high stretch ratios can be applied. Also, in the present process, high stretch ratios can be reached together with high stretching speeds. The stretching speed is the difference between the pulling speed (of the stretch roll) and the supply speed (of the feed roll) per unit of stretching zone and is expressed in $sec^{-1}$. In applying the present process the stretching speed can thus be 0.5 $sec^{-1}$ or more.

In order to be able to obtain the required high modulus values, stretching must be carried out below the melting point of the polyethylene. The stretching temperature is generally about 135° C. at most. When stretching is carried out below about 75° C., the results obtained are no longer satisfactory, and that is why the stretching temperature should be at least about 75° C.

Furthermore, it has been discovered that, as the molecular weight increases, the moduli that can be reached and particularly the tensile strengths that can be reached will increase. Preference is therefore given to processing a polyethylene with a molecular weight ($M_w$) of at least about $8\times10^5$. As the molecular weight of the polyethylene increases, the polyethylene will be more difficult to process. The dissolution in a suitable solvent will be more time consuming, with the same concentration the solutions will be more viscous and thus the spinning speeds that can be reached will be reduced, and during the stretching breaking will occur sooner. Because of the filler the viscosity can be further increased. Therefore, polyethylene with molecular weights ($M_w$) beyond about $15\times10^6$ will generally not be used, though the present process can be applied with higher molecular weights. The weight average molecular weights ($M_w$) can be determined according to known methods by gel permeation chromatography or light scattering.

The choice of the solvent is not critical. Any suitable solvent can be used, such as halogenated or non-halogenated hydrocarbons. In most solvents, polyethylene is soluble only at temperatures of at least about 100° C. In applying usual spinning methods the space in which the filaments are spun is under atmospheric pressure. Low boiling solvents are therefore less desirable, because they may evaporate from the filaments so rapidly that they will function more or less as foaming agents and will disturb the structure of the filaments.

During the spinning the temperature of the solution is preferably at least about 100° C. and preferably at least about 120° C., and the boiling point of the solvent is preferably at least about 100° C. and preferably at least equal to the spinning temperature. The boiling point of the solvent must not be too high that it is difficult to evaporate it from the filaments spun. Suitable solvents are aliphatic, cycloaliphatic and aromatic hydrocarbons with boiling points of at least about 100° C., such as octane, nonane, decane or isomers thereof and higher straight or branched hydrocarbons, petroleum fractions with boiling ranges above about 100° C. toluenes or xylenes, naphtalene, hydrogenated derivatives thereof, such as tetralin, decalin, but also halogenated hydrocarbons and other known solvents. Because of cost, preference is normally given to non-substituted hydrocarbons, including also hydrogenated derivatives of aromatic hydrocarbons.

The spinning temperature and the dissolution temperature must not be too high as to result in substantial thermal decomposition of the polymer. These temperatures will therefore generally not be chosen above about 240° C.

Unexpectedly, it has been discovered that the present process results in filled filaments with a greater modulus and strength than can be made by melt spinning of the same polymer under the same stretching conditions, such as the same stretching temperature and stretching speed. In applying the present process it has been found that higher stretch ratios are possible than in melt spinning the same polymer with the same filler.

In the usual processes for the spinning of solutions the diameters of the dies in the spinnerets are often small. Generally the diameters are about 0.02–1.0 mm. The width of the slits of slit dies may be a few mm to a few cm or more. Particularly if small dies (about 0.2 mm) are used, it has been discovered that the spinning process is very sensitive to impurities in the spinning solution. The solution must be carefully cleared and kept clear of solid impurities. The spinnerets are mostly provided with filters. Nevertheless, it has been found that the spinnerets must be cleaned after a short time and that clogging occurs frequently. In applying the present process larger dies or more than about 0.2 mm, for instance about 0.5–2.0 mm or more, can be used, because the stretch ratios may be high and, moreover, rather low concentrations of polymer are used in the spinning solution.

The filaments produced according to the invention are suitable for many uses. They can be used as reinforcement in many materials of which the reinforcement with fibers or filaments is known, for tire yarns and for all uses in which a small weight combined with great strength is desirable, such as, for instance, rope, nets, filter cloths, etc.

If so desired, minor quantities of the usual additives, stabilizers, fiber treating agents and the like, specifically quantities of 0.1–10% by weight in respect of the polymer, can also be incorporated in or on the filaments according to the invention.

The invention will further be elucidated by the following examples without being limited to them.

EXAMPLES

Example I

Figure 2:
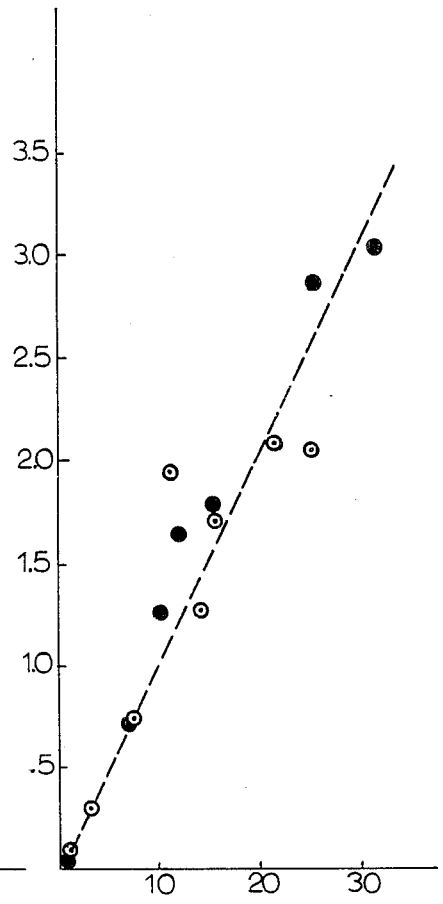
FIG. 2 is a graphical representation of the tensile strength plotted against the stretch ratio for the filaments prepared in Example I and Comparative Example A.

2% by weight of high molecular linear polyethylene with a $M_w$—$1.5\times10^6$ was suspended in decalin. Subsequently, 30% by volume (in respect of the polyethylene) of gypsum fiber with a length of about 0.02 mm and a thickness of about 0.002 mm (commercially available as Franklin Fiber) was added. During firm stirring heating was effected to 165° C. A highly viscous solution was formed of the polyethylene, in which the gypsum fibers were suspended. This solution containing gypsum fibers was subsequently spun, at 140° C., through a spinneret with a die of a diameter of 1.0 mm to form a continuous filament, which was subsequently stretched in a stretching oven of one meter's length, which was kept at 130° C. The stretching speed was about 0.5 $sec^{-1}$. The stretch ratio was varied between three and more than 20. Of the dried and stretched filaments the modulus and tensile strength were determined. The values of the modulus and the tensile strength (in GPa), as functions of the stretch ratio are shown respectively in FIG. 1 and FIG. 2 (Open points, 0).

Scanning electron microscopy shows that the gypsum fibers have an extremely good orientation in the direction of the filament, and EDAX photography* shows that the gypsum fibers are distributed very homogeneously over the polyethylene filaments.

*EDAX Energy Dispersive Analysis of X-rays

Comparative Example A

For the purpose of comparison, a solution of 2% by weight of high molecular polyethylene in decalin was prepared (no addition of filler) and spun to form a fiber, which was stretched at 130° C. with varying stretch ratios. The values of the modulus and the tensile strength as functions of the stretch ratio are shown respectively in FIG. 1 and FIG. 2 by closed points (0). The modulus of the filaments filled with gypsum fiber (Example I) has been found, at a given stretch ratio, to be higher than that of unfilled filaments, while the tensile strength of the filled filaments was not smaller than that of unfilled filaments.

Example II

According to the process of Example I, 15% by volume (in respect of the polymer) of glass globules was added to a mixture of 2% by weight of polyethylene ($M_w = 1.5 \times 10^6$). The diameter of the glass globules was 0.1 mm. The mixture was homogenized at 165° C. while being stirred firmly and was subsequently spun through a slit die to form small ribbons, and after a substantial part of the solvent had been evaporated in a heated spinning shaft, the ribbon was stretched at 120° C. The stretching was not adversely affected by the presence of the glass globules.

Stretch ratios of 40 or more could easily be realized.

The stretched polyethylene/glass globule film has a rough surface, which will benefit its possible application in a matrix.

Microscope photography shows the good distribution of the glass globules in the high molecular polyethylene film.

Example III

2% by weight of high molecular polyethylene in decalin and 20% by volume of Aerosil particles calculated in respect of the quantity of polyethylene were homogenized at 165° C. and spun to form a thread, which was stretched at 120° C. to stretch ratios of 25 or more. The Aerosil particles were found not to affect the stretching adversely.

Because of the presence of the Aerosil particles, the filament had acquired a rough surface, which may be favorable for various uses.

Si-X-ray photography (using EDAX) shows that the dispersion of the Aerosil particles in the high molecular polyethylene filaments is very homogeneous.

Example IV

Example III was repeated but instead of Aerosil particles, 10% by volume of copper powder with an average particle size of about 0.01 mm was mixed in. The filaments were stretched at 130° C. to stretch ratios of 20 and more.

Example V

Example IV was repeated, 30% by volume of sodium chloride with an average diameter of about 0.3 mm being used as filler. The polyethylene filaments filled with sodium chloride could be stretched at 130° C. 15–20 times. The mechanical properties were found in no way to be affected adversely by the presence of the relatively large salt crystals in the high molecular polyethylene fibers.

Scanning electron microscopy shows that the salt crystals are fully incorporated in the stretched fibers.

Example VI

In the manner described in Example I, a solution of polyethylene in decalin, containing 40% by volume (calculated in respect of polyethylene) of kaolin (Burges-KE) was prepared. The kaolin containing solution was spun and stretched at 130° C. with stretch ratios to 15 times. The particle size of the kaolin was about five micrometers. The stretching was not adversely affected by the kaolin. In this case the strength and the modulus were a little lower.

Si-X-ray photography (EDAX) shows a homogeneous distribution of the kaolin particles.

Example VII

According to the process of Example VI, 30% by volume of micro-mica was distributed in a solution of 2% by weight of high molecular polyethylene in decalin. The filler containing solution was spun, and the filaments were stretched at 130° C. to 15 times. The particle size of the micro-mica was about five micrometers. The strength and the modulus were again lower.

What is claimed is:

1. Process for the production of filaments with a high modulus and high tensile strength comprising the steps of, (a) preparing a filler containing solution of a linear polyethylene with a weight-average molecular weight of at least about 400,000, (b) spinning said filler containing solution of step (a) to form a filament by cooling without substantial evaporation of solvent to form a gel, and (c) stretching said filament at a stretching ratio of at least about $12 \times 10^6/M_w + 1$.

2. Process in accordance with claim 1, wherein said admixture contains about 5% to about 60% by volume of filler calculated in respect of said polyethylene.

3. Process in accordance with claim 1 including the intermediate step of removing at least about 50% by weight of solvent from said filament of step (b) before stretching.

4. Process in accordance with claim 3 wherein sufficient solvent is removed so that said filament contains about 25% by weight of solvent while stretched.

5. Process in accordance with claim 1, wherein said solution contains about 1% to about 50% by weight of polyethylene.

* * * * *